US008276658B2

(12) United States Patent
Cox et al.

(10) Patent No.: US 8,276,658 B2
(45) Date of Patent: Oct. 2, 2012

(54) MULTI-CHANNEL, COMBINATION COILED TUBING STRINGS FOR HYDRAULICALLY DRIVEN DOWNHOLE PUMP

(75) Inventors: James C. Cox, Farmington, NM (US); Dennis R. Wilson, Aztec, NM (US); Christine A. Buczek, Farmington, NM (US); John C. Patterson, Cypress, TX (US); Thomas E. Nations, Katy, TX (US); Curtis G. Blount, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 158 days.

(21) Appl. No.: 12/636,284

(22) Filed: Dec. 11, 2009

(65) Prior Publication Data

US 2010/0230112 A1 Sep. 16, 2010

Related U.S. Application Data

(63) Continuation-in-part of application No. 12/363,474, filed on Jan. 30, 2009.

(51) Int. Cl.
*E21B 43/00* (2006.01)

(52) U.S. Cl. ..... 166/73; 166/68.5; 166/105; 166/369

(58) Field of Classification Search ..... 166/369, 166/68.5, 105, 51.1, 73
See application file for complete search history.

(56) References Cited

U.S. PATENT DOCUMENTS

| | | | | |
|---|---|---|---|---|
| 2,432,079 | A * | 12/1947 | Albert, Jr. | 166/62 |
| 3,422,892 | A * | 1/1969 | Bryant, Jr. | 166/261 |
| 5,638,904 | A * | 6/1997 | Misselbrook et al. | 166/384 |
| 5,806,598 | A * | 9/1998 | Amani | 166/372 |
| 2003/0196815 | A1 * | 10/2003 | Crawford et al. | 166/369 |
| 2005/0082064 | A1 * | 4/2005 | Foster et al. | 166/303 |

* cited by examiner

*Primary Examiner* — Brad Harcourt
(74) *Attorney, Agent, or Firm* — ConocoPhillips Company

(57) ABSTRACT

This invention relates to a downhole hydraulic pump for hydrocarbon wells that is installed and operated using coiled tubing. The downhole hydraulic pump is driven by a hydraulic power system positioned at the surface and connected through a closed loop system using multiple channels of the coiled tubing. The coiled tubing is formed of a combination of channels including strength component such as steel and having one channel that is at least lined with a non-metallic corrosion resistant surface where clean hydraulic fluid is carried from the hydraulic power system to the downhole hydraulic pump through the non-metallic corrosion resistant channel so to be less likely to pick up manufacturing and environmental particulates and corrosion by-products within the channel carrying the hydraulic fluid to the downhole hydraulic pump. The non-metallic corrosion resistant lined channel may comprise plastic pipe.

8 Claims, 5 Drawing Sheets

MULTI-CHANNEL, COMBINATION COILED TUBING STRINGS FOR HYDRAULICALLY DRIVEN DOWNHOLE PUMP

CROSS-REFERENCE TO RELATED APPLICATIONS

This application is a continuation-in-part application which claims benefit under 35 USC §120 to U.S. application Ser. No. 12/363,474, filed Jan. 30, 2009 and entitled "Hydraulically Driven Downhole Pump Using Multi-Channel Coiled Tubing".

STATEMENT REGARDING FEDERALLY SPONSORED RESEARCH OR DEVELOPMENT

None

FIELD OF THE INVENTION

This invention relates to pumping fluids from the bottom of a wellhole.

BACKGROUND OF THE INVENTION

In natural gas wells, it is common for fluids such as water to be produced that if allowed to remain in the wellhole, will choke the production of natural gas. Pumping such fluids to the surface increases the gas productivity of such wells and increases the profits of the well owners. However, most gas wells are not straight or vertical. Many have deviations and it is common to drill substantial deviations to increase well contact with the productive zone. Another reason for directional drilling is to reduce the environmental impact of oil and gas production by drilling from existing well or drilling sites with the aim of reaching out underground to new hydrocarbon bearing zones to get access to additional reserves with a minimal footprint. Such deviated wells make pumping with a pump driven by a reciprocating rod or rotating shaft unattractive as the casing is likely to be worn and breached over time. Moreover, the frictional losses increase the horsepower requirements and increases costs of production.

Another challenge with pumping wells is the cost of repairing or replacing a pump. With reciprocating rod pumps, electrically driven pumps and hydraulically driven pumps, the problems with friction and deviated wells may be avoided, but even these types of pumps suffer problems and must be removed and replaced. Typically, when a problem occurs with a well, a workover rig is required to pull the pump back to the surface. It is not uncommon for a workover rig to take four days to pull a pump and then insert the repaired or replacement pump back into location. This does not take into account the availability of a workover rig. As such, the well may be offline for a week or more and seriously cut into the profitability of the gas well.

SUMMARY OF THE INVENTION

The present invention provides an arrangement for connecting a hydraulic powered downhole pump to a multi-channel coiled tubing string with a closed loop connection to a hydraulic power source at surface. High pressure hydraulic fluid is supplied down a first channel in the coiled tubing string with returning hydraulic fluid coming up a second channel. This system is installed in yet a third string which is jointed production tubing. The well fluids are pumped by the hydraulic pump up the annulus area inside the jointed production tubing and outside the coiled tubing string. The first channel has non-metallic, corrosion resistant interior surfaces.

The invention further relates to a process for producing a hydrocarbon gas well including the steps of providing a hydraulically driven pump in a downhole position and at the distal end of a multi-channel coiled-tubing string.

A process for co-producing hydrocarbon gas and produced fluids separately from a wellbore wherein the process comprises providing casing in the wellbore and inserting production tubing within the casing. A hydraulically driven downhole pump is attached to the distal end of a multi-channel coiled tubing string and then inserted into the production tubing within the wellbore. The process further includes providing high pressure hydraulic fluid from a hydraulic power unit to the distal end of the multi-channel coiled tubing string so that high pressure hydraulic fluid is delivered by the hydraulic power unit and to the downhole hydraulically driven pump and returns to the hydraulic power unit through a second channel in the multi-channel coiled tubing string thereby pumping produced fluid in the wellbore up through the annular space within the production tubing but outside the multi-channel coiled tubing string while hydrocarbon gas is produced in the annular space within the casing but outside the production string and further wherein the first channel is characterized by non-metallic, corrosion resistant interior surfaces.

In a further preferred arrangement of the invention, the process includes assembling the multi-channel coiled tubing as a concentric coiled tubing string with fittings to seal the bottom and top ends for pumping hydraulic fluid in a closed loop while also providing simpler processes for pulling and replacing the pump in the event of pump failure and other downhole issues.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Figure 1:
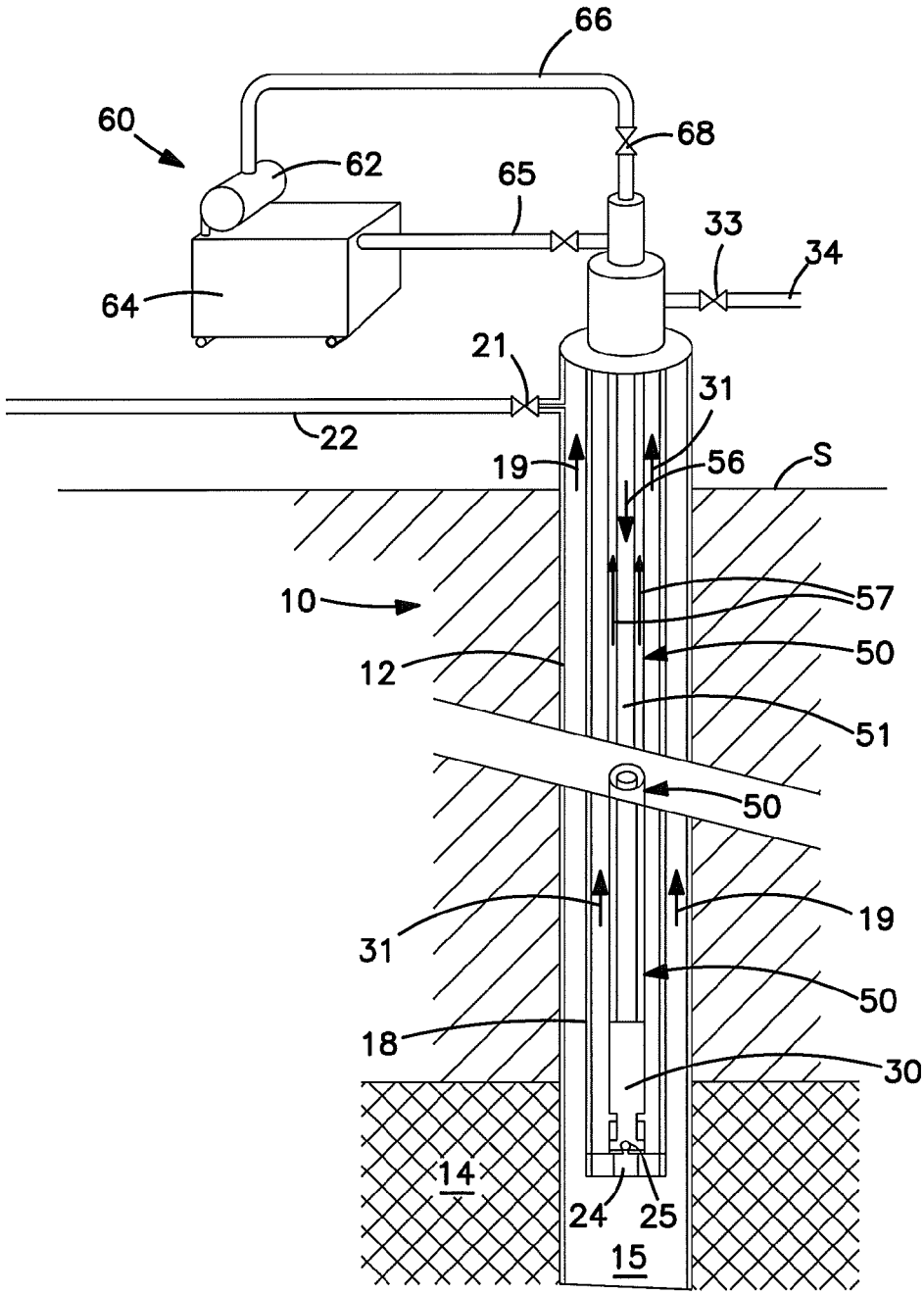
FIG. 1 is a fragmentary view of the coiled tubing string connected to a hydraulic pump illustrating the gas production annular space, the liquid production annular space and the closed hydraulic system for driving the hydraulic pump.

This invention relates to producing water and other fluids in a gas well where the fluids must be produced to avoid restricting the production of hydrocarbon gas. As best seen in FIG. 1, the invention is generally indicated by the numeral 10. The invention 10 is positioned within a well that has been drilled or bored into the ground and in which a string of casing 12 has been inserted. It is conventional for the casing to extend below the surface S down through the ground into a production zone 14. The production zone 14 is where the gas and fluids permeate toward the casing 12 and enters the production well 15 at the base of the casing 12. Fractures (not indicated) are created in the casing 12 in the proximity of the production zone 14 so that, according to conventional procedures, the gas permeates from the production zone 14 and into the production well 15.

Within the casing 12 is positioned a production tubing 18 through which any fluids may be produced to the surface. The gas in the production well 15 is produced through the annular space between the outside of the production tubing 18 and the inside of casing 15 as indicated by arrows 19. The gas is directed through a valve 21 and piping 22 to a production meter and a gathering system and perhaps other post production treatments before it is conveyed to market.

Near the base of the production tubing 18 is a hydraulically driven downhole pump 30. Various hydraulic pump styles will be useful with the present invention, however, it is preferred to use a hydraulic diaphragm pump also called a hydraulic diaphragm insert pump or HDI pump. The preferred HDI pump is available from Smith Lift, an Operating Unit of Smith International, Inc. The hydraulically driven downhole pump 30 is arranged at the base of the production tubing 18 so as to draw water and other produced fluids that settle in the production well 15 up into the production tubing 18 through a nipple 24 at the base of the production tubing 18 and up through standing valve 25. As is conventional, once the fluids pass through the nipple 24 and standing valve 25 into production tubing 18, the fluids are not permitted to drain back into the production well 15. In operation, the hydraulic pump 30 pushes the fluids up through the production tubing 12 to the surface as indicated by arrows 31 until the fluids are collected through valve 33 and piping 34. It is not uncommon for the fluids to include valuable hydrocarbon fluids so their collection may be quite profitable. At the same time, any water may require treatment to separate valuable fluids and may be disposed of by re-injection or other environmentally acceptable disposal means.

Figure 3:
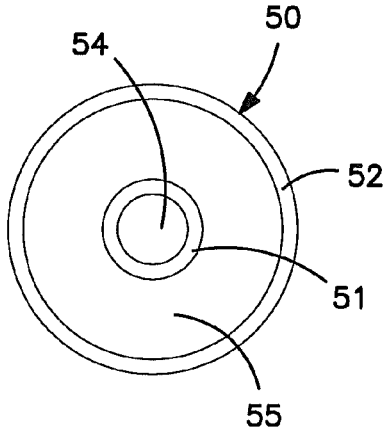
FIG. 3 is a cross section of a first embodiment of a coiled tubing string for use with the present invention.
Figure 4:
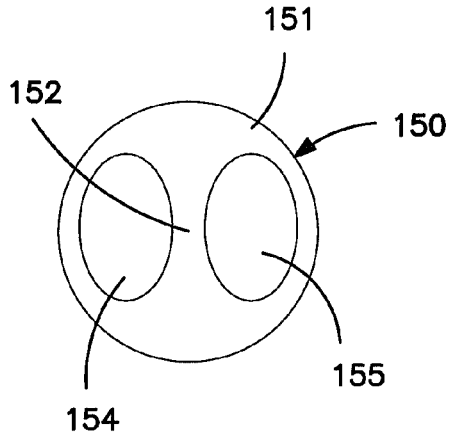
FIG. 4 is a cross section of a second embodiment of a coiled tubing string that is suitable for use with the present invention.
Figure 7:
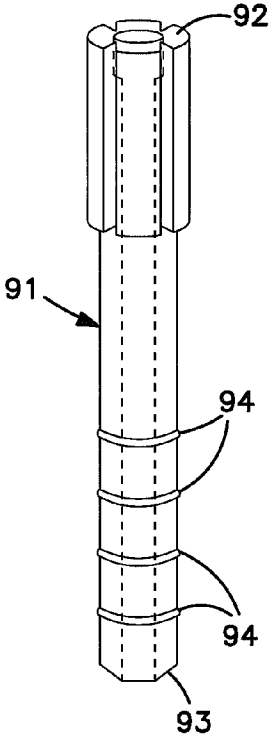
FIG. 7 is a perspective view of the stinger.

Within the production tubing 18 is a multi-channel coiled tubing string 50. In the preferred embodiment and referring to FIG. 3, the multi-channel coiled tubing string 50 includes a concentric coiled tubing string 51 having a smaller diameter inserted within a larger diameter coiled tubing string 52. With this concentric coiled tubing string, axial channel 54 is defined which is separate from annular channel 55. For comparison, referring to FIG. 4 is a second embodiment of a coiled tubing string 150 having side by side channels defined by the outer wall 151 and a continuous web section 152 that separates a first channel 154 from a second channel 155. Other structural arrangements for coiled tubing having multiple channels would also be useful with the present invention. With multiple channels, the third and subsequent channel may be used for pump or other well control or may be adapted to carry the produced liquids to the surface through an additional channel Turning back to FIG. 1, the hydraulically driven downhole pump 30 is connected to the base or distal end of coiled tubing string 50 so as to be inserted into position by a coiled tubing unit as the coiled tubing string 50 is inserted into the production tubing 18 of the wellbore. A coiled tubing unit is generally smaller, less expensive and is operated with fewer people than a workover rig. With no joints to assemble or disassemble, coiled tubing may be quickly inserted into a borehole, withdrawn and re-inserted. With the hydraulically driven downhole pump 30 attached to the bottom or distal end of the coiled tubing string 50, the pump is also quickly and easily installed, retrieved and replaced as compared to the same job being performed by a workover rig that uses approximately thirty foot segments of pipe or rod connected by threaded joints at each end.

Figure 2:
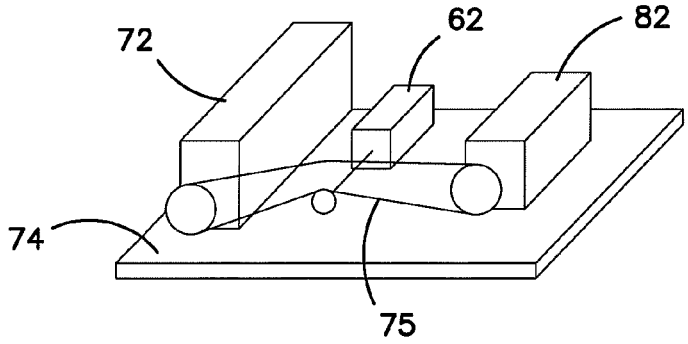
FIG. 2 is a perspective view of a production skid at the surface adjacent a hydrocarbon producing well.

In operation, the hydraulically driven downhole pump 30 is driven by a hydraulic drive unit generally indicated by the numeral 60 at the surface. Hydraulic drive unit 60 includes a hydraulic power unit 62 sometimes called a hydraulic pump but to avoid confusion with pump 30 the term "hydraulic power unit" is employed. The hydraulic power unit 62 is of conventional design that draws hydraulic fluid from reservoir 64 and delivers high pressure hydraulic fluid through tubing 66. Referring to FIG. 2, hydraulic power unit 62 may be driven by an internal combustion engine 72 or other suitable drive unit such as an electric motor. In the field, it is conventional to use whatever power source is available and cost effective. Mounting equipment for use in the field on a skid unit such as skid unit 74 is well known. As such, the internal combustion engine 72 is shown mounted on a skid unit 74 along with hydraulic power unit 62.

Referring back to FIG. 1, the hydraulic fluid is directed into the first axial channel 54 to provide high pressure fluid to the hydraulically driven downhole pump 30 at the distal end of the coiled tubing string 50. The high pressure hydraulic fluid is preferably provided continuously at a relative constant pressure as compared to a push/pull stroke from the surface. The high pressure hydraulic fluid may run over vanes to cause rotational motion of the pump 30 and therefore pumping of the fluid or, as preferred, the high pressure hydraulic fluid is directed through valves in the hydraulic pump that causes positive displacement of the fluids in the annular space inside the production tubing 18 and outside the coiled tubing string 50.

As is known in the pumping arts, a positive displacement pump will cycle from drawing fluid into a chamber through one or more one-way valves in one stroke and then push the fluid out of the chamber through a reverse stroke through one or more one-way valves that lead to the desired space for the fluid. The preferred embodiment of the present invention seeks to take advantage of known systems utilizing valving in the pump that allows the pump to extend through a full stroke and then actuated by the completion of the stroke and begin to use the source of high pressure to reverse the stroke and cycle back and forth pushing fluids to the surface. Considering the depth of some wells, having the valving to reverse the stroke at the surface with the hydraulic power is not preferred as delays from sensing the end of the stroke and over pressure situations are likely to occur. Pump reliability is an issue with pumps in wells and while the present invention is intended to help minimize the cost of deploying and replacing pumps, anything to improve the reliability of pumps improves the profitability for the well owner.

So in preferred operation, the high pressure hydraulic fluid is directed down the axial channel 54 of the concentric coiled tubing 50 and follows the path shown by arrow 56. The high pressure hydraulic fluid is then used by the hydraulically driven downhole pump 30 to drive fluids up the annular space outside the coiled tubing 50 and inside the production tubing 18 to follow the path indicated by the arrows 31. At the same time, the hydraulic fluid used by the hydraulically driven downhole pump 30 flows back to the surface in an annular channel 55 along a path indicated by arrows 57 and back to reservoir 64 through tubing 65. With the fluids withdrawn from the production well 15, the gas production flows up the annulus outside of the production tubing 18 and within the casing 12 along a path indicated by arrows 19. It should be noted that the hydraulic fluid is not permitted to mix with the production fluids and that there are at least four distinct and separate flow channels created within the casing 12 by the production tubing 18 and the multi-channel coiled tubing 50. One flow channel is downward and three are upward.

In one aspect of the present invention, hydraulic fluid returning to the surface is directed through a filter (not shown) to remove any silt, debris or contaminants prior to entry to the reservoir 64 or at least prior to entry to the hydraulic power unit 62. Clean hydraulic fluid is delivered through the hydraulic power unit 62 down to the pump 30. One issue that has arisen is the formation of particulates and debris in metal, or more specifically steel coiled tubing. Conventional coiled tubing is typically formed of steel and even stainless steel is subject to some corrosion. In addition to corrosion, the manufacturing processes used for making these steels produce many environmental contaminates and undesired particulates which adhere to the surfaces of these steels. These contaminates, particulates and the corrosion by-products which may form on the steel or metal surfaces can break off from inside the coiled tubing become entrained inside the hydraulic fluid and interfere with the hydraulic pump 30 and any valves or other downhole equipment. In an effort to control this potential problem, in the preferred embodiment of the present invention, the tubing string 51 is formed of a non-metallic corrosion resistant polymer based tubing perhaps, commonly described as plastic pipe so as to have non-metallic, corrosion resistant interior surfaces in contact with the hydraulic fluid. While it may not be practical to use plastic pipe for all of the conduits as considerable strength is needed to insert the combination of tubing strings down hole, especially with a hydraulic insert pump attached to the end. A metallic coiled tubing such as steel coiled tubing or composite coiled tubing having reinforcing fibers formed in the wall of the tubing should be used to provide the needed strength. In the embodiment shown in FIG. 4, the first channel is lined with a non-metallic corrosion resistant plastic material. The remainder of the coiled tubing may be made of differing materials, preferably steel, to provide high strength at reasonable cost.

In another aspect of the present invention, as more particularly shown in FIG. 2, the internal combustion engine 72 may be used to drive other systems at the well. As shown, gas compressor 82 is shown being driven by belt 75 along with hydraulic power unit 62. Sharing the power source for different systems reduces costs and improves the bottom line for marginal wells. In addition, since multiple wells are being drilled from existing or common drill sites, it is another aspect of the invention to operate hydraulic pumps for several wells based on a common internal combustion engine 72. In such an arrangement, the internal combustion engine may be run continuously and the various demands of different wells and compressing the produced gas from one or more wells while the control systems may operate the various hydraulic pumps on an intermittent basis.

In the preferred embodiment, the hydraulic fluid directed down the axial channel 54 and back up the annular channel 55 of the coiled tubing sting 50 comprises a water based biodegradable hydraulic fluid that will cause little if any hazard if there is a spill or leak. It certainly will be recognized by those skilled in the art that any hydraulic fluid can be used to operate the pump.

In the most preferred embodiment, concentric coiled tubing string 50 comprises two coiled tubing strings. The first is a ¾" coiled tubing string (power-string) placed inside of a 1½" coiled tubing string (return-string). The high pressure hydraulic fluid is pumped from the surface down the ¾" non-metallic coiled tubing string. The return fluid is directed up the annular channel 55 outside of the ¾" inner coiled tubing string 51 and the inside of the 1½" outer coiled tubing string 52. The concentric coiled tubing strings are sealed on bottom with a stinger and receiver seal-assembly combination as are known. The concentric coiled tubing strings are sealed at the surface with a combination of fittings as are also known by those using coiled tubing. The concentric coiled tubing, seal assembly and associated fittings ensure that the hydraulic fluid is contained within the closed-loop throughout the pumping process.

Figure 6:
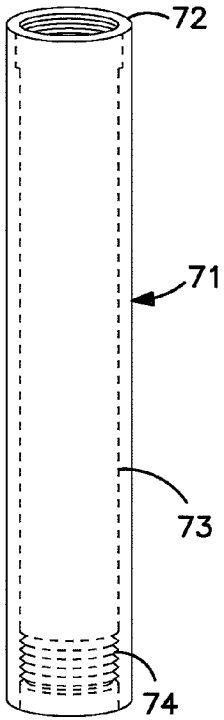
FIG. 6 is a perspective view of the return fitting.
Figure 5:
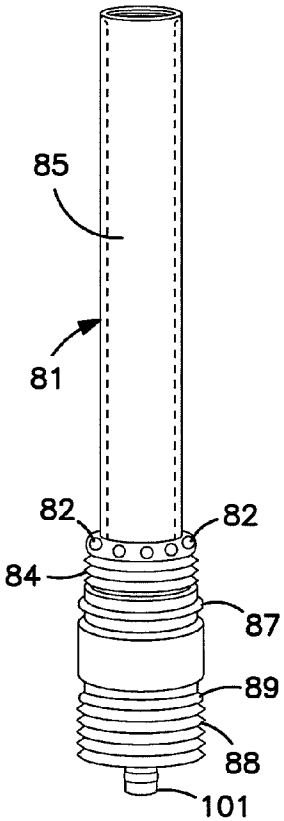
FIG. 5 is a perspective view of the pump adaptor.

Concentric coiled tubing is not new. However, it is not generally available from coiled tubing manufacturers or vendors. The inventors have developed a new and inventive procedure to insert a smaller diameter coiled tubing string into a larger coiled tubing string and, if necessary, to easily remove it. The process begins onsite at the well with production tubing 18 already installed within the casing 12. Referring to FIGS. 5 and 6, return fitting 71 is attached to the bottom end of the outer coiled tubing string 52 while the outer coiled tubing string is still wound on the coiled tubing unit. Preferably, the end 72 is welded to the bottom end of the outer coiled tubing string 52. Pump adaptor 81 is connected by screw threads 84 into screw threads 74 of return fitting 71. Upper receiver end 85 of pump adaptor 81 extends up inside returning fitting 71 so that the outer surface of the upper receiver end 85 forms an annular space within the inner surface 73 of return fitting 71. The connection between the return fitting 71 and the pump adaptor 81 is preferably sealed by suitable o-rings 87. A cap (not shown) is attached over screw threads 88 and sealed by o-ring 89 and the entire length of the coiled tubing string 52 may be filled with a suitable well control fluid.

Figure 8:
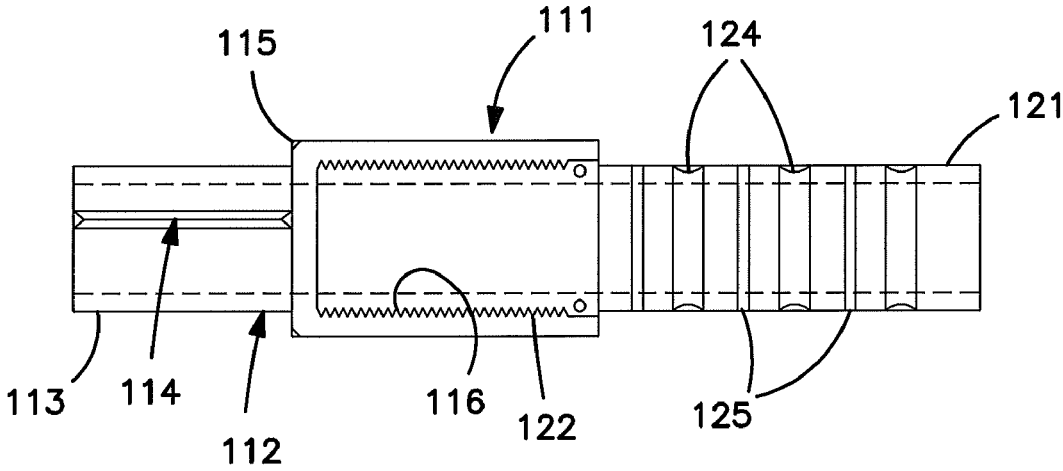
FIG. 8 is an elevation view of the top end coiled tubing fixture.

The outer coiled tubing string 52 is then run into the production tubing 18 until the cap comes into contact with the nipple 24. The outer coiled tubing string 52 is then cut to length. The smaller diameter inner coiled tubing string 51, still wound on a coiled tubing unit spool, is provided with stinger 91 attached to the bottom end thereof. The top end 92 of stinger 91 is secured onto the end of the smaller diameter inner coiled tubing string and the coiled tubing unit is arranged to then insert the smaller diameter inner coiled tubing string 51 into the outer coiled tubing string disposed within the production tubing 18. Tapered end 93 of stinger 91 eventually stings into the open end of the pump adaptor 81 and seal against the interior of the upper end thereof with o-rings 94. At the top end of the coiled tubing strings, a top end coiled tubing fixture 111 shown in FIG. 8 is attached to the outer coiled tubing string 52. The top end coiled tubing fixture 111 comprises two components that are connected by screw threads. The first component 112 comprises a first end 113 for insertion into the outer coiled tubing string 52. The first end 113 includes a longitudinal outer surface groove 114 to align with any welding seam in the coiled tubing. The first component 112 is intended to have a tight fit with the outer coiled tubing string and may be hammered to fully seat the collar 115 to the end of the outer coiled tubing string 52. Once in place, the first component 112 of the fixture is welded to the outer coiled tubing string 52 so as to seal the two together. The second component 121 attaches to the first component 112 by screwing the threads 122 into the threads 116 of the first component and the free end is configured with radial grooves 124 and o-rings 125 for having a tail section (not shown) of coiled tubing crimped thereon for pulling the concentric coiled tubing out of the well on wound onto coiled tubing unit spool. With this arrangement, each time the coiled tubing and pump are pulled and re-installed, the length of the two coiled tubing strings is preserved.

The coiled tubing unit is position over the well to connect to the upper end of the second component 121 of top end coiled tubing fixture 111 to withdraw both coiled tubing strings 51 and 52. In another aspect of the present invention, it is not uncommon for particulates and other surface debris to become loosened from the surfaces of both strings of coiled tubing. As such, the debris may pose a risk to the long term operation of the hydraulic pump and it is preferred that such debris is removed from the systems. In respect of this concern, once the two strings of coiled tubing are installed into the well and then pulled in preparation for installing the hydraulic pump, the bottom end of the two strings are opened by the removal of the cap that was attached to the end of the pump adaptor at threads 88. Cleaning fluid may be pumped through the coiled tubing while wound on the coiled tubing unit and filtered and recycled until the operator is satisfied that any loosed particles have been removed from the system. With this simple step, it is anticipated that operational availability of the pump has been extended.

The hydraulically driven downhole pump 30 is then attached to the screw threads 88 so that the hydraulic fluid inlet of the pump is connected to fitting 101 and the hydraulic fluid outlet flow passes through the pump adaptor 81 and into the annular channel 55 through holes 82. Holes (not shown) are positioned at the bottom of the pump adaptor 81 between the screw threads 88 and fitting 101 which are in fluid communication with holes 81 so that low pressure hydraulic fluid then passes up through the annular channel 55. Once the hydraulically driven downhole pump 30 is attached to the end of the concentric coiled tubing strings 51 and 52, and the string is inserted into the production tubing so that the hydraulically driven downhole pump 30 engages and seals in nipple 24, the coiled tubing strings 51 and 52 may also be cut to length and provided with fittings for connection to tubing 65 and 66.

As noted above, a particular advantage of the present invention is that a single coiled tubing unit may quickly pull the multi-channel coiled tubing string out of the well with the pump attached. However, if the pump or coiled tubing string is stuck or gets stuck while being pulled, a new problem emerges. When it is clear that the coiled tubing will break under the tension of the unit against the "stuck" pump, the coiled tubing can be withdrawn by an inventive technique to minimize the hassle and time involved with recovering the pump and getting the well back into service. If the tubing is cut off at the surface and a workover rig is called in to withdraw the production tubing, additional coiled tubing will have to be cut as each joint of production tubing is broken apart. With a production tubing string being many thousands of feet, significant additional time could be wasted cutting the coiled tubing or worse yet, cutting two strings concentrically disposed. In the inventive process, the inner non-metallic coiled tubing string 51 is withdrawn by un-stinging the stinger 91 from pump adaptor 81. Then a wireline free point tool may be inserted into the outer tubing. The wireline free point tool is able to measure minute stretching in the tubing and by sequentially pulling and releasing the tubing can determine "free point" or the lowest point at which the tubing is "not stuck". Weatherford International Ltd is a well known oil field services company that provides such free point tools and services. The free point tool is removed and a chemical or explosive cutting tool is run down into the outer coiled tubing string to a point just above free point to cut the outer coiled tubing string 52 so that the coiled tubing unit can pull the free portion of the coiled tubing string out of the production tubing. Then the workover rig can then pull the production tubing 18 and only deal with the length of stuck coiled tubing attached to the pump 30. Once the pump is recovered, the production tubing 18 and pump 30 along with the multi-channel coiled tubing may be re-installed in the well to return it to productive service.

Figure 9:
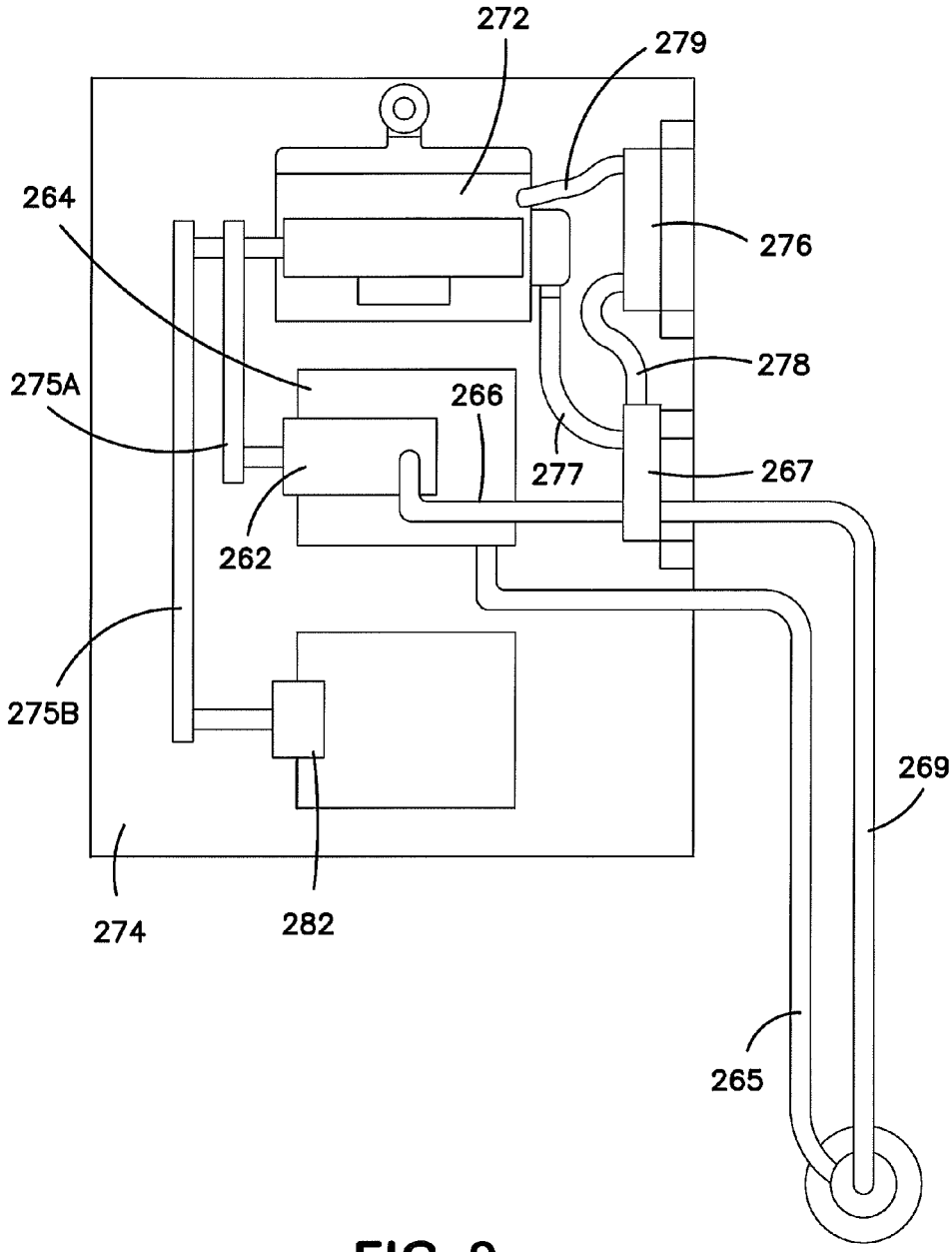
FIG. 9 is a schematic top view of an alternative embodiment of a production skid at the surface adjacent a hydrocarbon producing well.

In another aspect of the present invention, wells that produce a lot of gas and fluid generally remain fairly warm as the fluids entering the wellbore retain the heat energy of the formation. However, in circumstances where small amounts of gas and fluids are produced, cool nights may allow water to freeze inside the well bore and for paraffinic hydrocarbons to congeal as wax. In one embodiment of the invention, such problems can be addressed by an arrangement shown in FIG. 9. A skid unit 274, which is similar to skid unit 74 in FIG. 2, is illustrated with an internal combustion engine 272 to drive the hydraulic power unit 262 and a gas compressor 282 by belts 275A and 275B, respectively. The internal combustion engine, as is conventional, is cooled by a fluid jacket in which coolant is pumped through and into a radiator 276. However, in the present invention, the coolant is first directed to a liquid/liquid heat exchanger 267 via conduit 277 where some of the engine heat is transferred to the hydraulic fluid used to drive the hydraulically driven downhole pump 30 at the base of the well. Coolant exits heat exchanger 267 via conduit 278 and enters radiator 276 and eventually returns to the engine 272. In FIG. 9, the hydraulic fluid is driven by hydraulic power unit 262 through conduit 266 to liquid/liquid heat exchanger 267. In the heat exchanger 267, heat is transferred from the engine coolant to the hydraulic fluid and the heated hydraulic fluid is then carried to the well via conduit 269. The warm hydraulic fluid then transfers some of its heat to the well to prevent or at least reduce the likelihood of ice forming downhole and prevent wax buildup by keeping any paraffins in the liquid above their cloud point temperature. The temperature of the hydraulic fluid may be maintained to be sufficiently above ambient air temperature with little operating cost and will maintain the wellbore and pipes therein well above freezing and above the cloud point of any paraffin in a gas well. It should be understood that it is preferred for the heat exchanger 267 to heat the hydraulic fluid prior to entering the well so that the hydraulic is warmest as it enters the well and is coolest when entering the hydraulic power unit 262.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. An apparatus for producing fluids in a wellbore wherein gas is produced through one annular space and fluids are produced through a separate space; wherein the apparatus comprises:

a. casing in the wellbore;

b. production tubing within the casing;

c. a hydraulically driven downhole pump within the production tubing and attached to the distal end of a multi-channel coiled tubing string that extends to the surface of the borehole;

d. a hydraulic power unit disposed at the surface and connected to the multi-channel coiled tubing string so as to provide high pressure hydraulic fluid into a first channel within the multi-channel coiled tubing string and receive hydraulic fluid through a second channel within the multi-channel coiled tubing string and together define a closed loop hydraulic fluid system where hydraulic fluid is not mixed with production fluids; whereby a fluid production space is defined within the production tubing and outside the multi-channel coil tubing driven by the hydraulically driven downhole pump and further whereby a gas production space is defined outside of the production tubing and within the casing and further wherein the first channel is characterized by non-metallic, corrosion resistant interior surfaces;

e. wherein the hydraulic power unit includes a power take off device and for a gas compressor for compressing the produced gas from the well site using a single power unit;

f. wherein the hydraulic power unit provides a continuous supply of high pressure hydraulic fluid through said first channel of said coiled tubing string and continuously receives lower pressure hydraulic fluid from said second channel of said coiled tubing string into a reservoir; and h. a heat transfer device for heating the hydraulic fluid and thereby heat the wellbore to prevent ice from forming and maintain any paraffinic hydrocarbons above their cloud point wherein the heat transfer device is a liquid/liquid heat exchanger where coolant from an internal combustion engine that is used to drive the hydraulic power unit is arranged to provide some of the heat in the coolant to the hydraulic fluid pump.

2. The apparatus according to claim 1, wherein the multi-channel coiled tubing string comprises two coiled tubing strings, one concentrically located within another defining the first channel to be axially within the inner coiled tubing string and the second channel being the annular space outside of the inner coiled tubing string and within the outer coiled tubing string and further wherein the inner coiled tubing is plastic coiled tubing.

3. The apparatus according to claim 1, wherein the multi-channel coiled tubing string comprises an outer wall and a continuous web section within the outer wall dividing the interior of the coiled tubing string into two separate and distinct side-by-side channels and wherein the first channel is lined with a plastic material.

4. The apparatus according to claim 1, further including a standing valve and seal assembly by which accepts the hydraulic pump and which provides well control during the insertion and pulling and replacing of the hydraulically driven downhole pump.

5. A process for co-producing hydrocarbon gas and produced fluids separately from a wellbore wherein the process comprises:

a. providing casing in the wellbore;

b. inserting production tubing within the casing to define an annular space within the casing where the annular space within the casing is outside the production tubing and within the casing in the wellbore;

c. attaching a hydraulically driven downhole pump to the distal end of a multi-channel coiled tubing string;

d. inserting the hydraulically driven downhole pump and multi-channel coiled tubing string into the production tubing within the wellbore and thereby define an annular space within the production tubing where the annular space within the production tubing is outside the multi-channel coiled tubing and within the production tubing;

e. providing high pressure hydraulic fluid from a hydraulic power unit to the distal end of the multi-channel coiled tubing string so that high pressure hydraulic fluid is delivered by the hydraulic power unit and to the downhole hydraulically driven pump and returns to the hydraulic power unit through a second channel in the multi-channel coiled tubing string thereby pumping produced fluid in the wellbore up through the annular space within the production tubing but outside the multi-channel coiled tubing string while hydrocarbon gas is produced in the annular space within the casing but outside the production string and further wherein the first channel is characterized by non-metallic, corrosion resistant interior surfaces;

f. providing power to the hydraulic power unit and providing compression of the produced gas from a common power source for the well site wherein providing power to the hydraulic power unit and providing compression of the produced gas from a common power source for the well site; and g. heating the hydraulic power fluid to thereby heat the wellbore and prevent the formation of ice and maintain any paraffinic hydrocarbons to be above their cloud point, where heating the hydraulic power fluid comprises heating the hydraulic fluid using heat from an internal combustion engine by providing coolant from the internal combustion engine into heat exchange contact with the hydraulic fluid.

6. The process according to claim 5, wherein the step of providing a multi-channel coiled tubing string comprises providing a multi-channel coiled tubing string having an outer wall and a continuous web section within the outer wall dividing the interior of the coiled tubing string into two separate and distinct, side-by-side channels and wherein the first channel is lined with a plastic material.

7. The process according to claim 5, wherein the step of providing a multi-channel coiled tubing string further comprises providing two coiled tubing strings, one concentrically located within another so that the first channel is axially within the inner coiled tubing string and the second channel in the annular space outside of the inner coiled tubing string and inside of the outer coiled tubing string and further wherein the inner coiled tubing is plastic coiled tubing.

8. The process according to claim 7, wherein the process further includes the steps of installing the outer coiled tubing string into the production tubing and then installing the inner coiled tubing string into the outer coiled tubing string, connecting the two coiled tubing strings together with a pump adaptor attached to the outer coiled tubing string and a stinger attached to the inner coiled tubing string and suited for stinging into the pump adaptor.

* * * * *